United States Patent [19]

Makino et al.

[11] Patent Number: 4,690,119

[45] Date of Patent: Sep. 1, 1987

[54] EGR VALVE DEVICE OF INTERNAL COMBUSTION ENGINES OF AUTOMOBILES

[75] Inventors: Hiroshi Makino; Akio Sasaki, both of Odawara, Japan

[73] Assignee: Mikuni Kogyo Kabushiki Kaisha, Japan

[21] Appl. No.: 893,776

[22] Filed: Aug. 6, 1986

[30] Foreign Application Priority Data

Aug. 6, 1985 [JP] Japan ..... 60-119953

[51] Int. Cl.[4] ..... F02M 25/06

[52] U.S. Cl. ..... 123/571; 251/129.03

[58] Field of Search ..... 123/188 AF, 568, 569, 123/571; 251/129.03, 129.11

[56] References Cited

U.S. PATENT DOCUMENTS 3,557,762 1/1971 Mitchell ..... 123/188 AF
4,064,851 12/1977 Wessel ..... 123/571
4,473,056 9/1984 Ishida et al. ..... 123/571
4,549,446 10/1985 Beeson ..... 251/129.03
4,561,408 12/1985 Jenkins ..... 123/571

*Primary Examiner*—Willis R. Wolfe, Jr.
*Attorney, Agent, or Firm*—Lalos & Keegan

[57] ABSTRACT

In order that an EGR valve device for internal combustion engines of automobiles can be manufactured in a compact size and at a low cost and also that its valve member can be immediately brought to its valve-closing position whenever the driving motor of the device fails, the EGR valve device comprises a sector-shaped gear operatively coupled to a valve member urged to close the valve and capable of causing the valve member to make opening and closing movements, and a driving motor whose shaft of rotary member is disposed so as to intersect at right angles a plane containing the sector-shaped gear and is provided with a pinion meshed with the sector-shaped gear.

3 Claims, 3 Drawing Figures

EGR VALVE DEVICE OF INTERNAL COMBUSTION ENGINES OF AUTOMOBILES

BACKGROUND OF THE INVENTION (a) Field of the Invention

The present invention relates to an EGR (Exhaust Gas Recirculation) valve device for an internal combustion engine of an automobile, which device being arranged so that a main shaft of a motor is operatively coupled to the valve member which is normally urged to close the valve, and that by applying to this motor an actuating signal obtained through computation on the basis of the amount of the fuel and also the amount of the air which are to be supplied to the engine and further on the informations delivered from various sensors, the degree of opening of the valve is controlled.

(b) Description of the Prior Art

The conventionally used EGR valve device is operated by the manifold vacuum of an engine, and a diaphragm has been employed to form its basic structure.

As such, in the conventional EGR valve device, its operation is influenced by the changes in the negative pressure which are caused due to the wear and degradation of the functions of the respective parts and sections of the engine, and accordingly it has been difficult to accomplish a proper and adequate control of the exhaust gas recirculation. Also, in case it is intended to increase the degree of opening of the conventional EGR valve, this has been entailed by a lowering of the negative pressure, while conversely in case a small degree of opening of the conventional EGR valve is required, this has been followed by an undesirable elevation of the negative pressure. As pointed out above exemplarily, it has been difficult to make an adequate control of the amount of the exhaust gas which is to be recirculated. In order to solve the above-mentioned problem, there has been proposed in the past an EGR valve device having the system such that the EGR valve is of the motor-driven type and that an actuating signal which is obtained through computation on the basis of the amount of the fuel supply and the amount of the air supply and also on the informations delivered from various sensors is applied to the driving motor, to thereby control the degree of opening of the valve (for example, Japanese Patent Preliminary Publication No. Sho. 57-193751). The valve device of the prior art having the above-mentioned system, however, has the following problems that, owing to the arrangement of the device that the main shaft of the motor and the valve rod of the EGR valve are screwed to each other in the "male and female screw" relationship, causing the valve rod to make forward and backward movements by the rotation of the motor, the device as a whole inevitably has tended to have an increased length in the direction of the valve rod, making it difficult to construct the device in a compact size, and further that, because a relatively large motor torque is required, the motor per se inevitably has tended to have a large size also. In addition, in case of a trouble of the motor, this is accompanied by the problem that the EGR valve is left in its open position, thus inducing the engine to plunge into a disorder.

SUMMARY OF THE INVENTION

It is, therefore, a primary object of the present invention to provide an EGR valve device arranged so that whenever the driving motor is brought to a halt due to a trouble in the electric system, the EGR valve is closed immediately so that the failure of the engine can be avoided.

Another object of the present invention is to provide an EGR valve device which, as a whole, can be made in a compact and small size and at a low cost.

Still another object of the present invention is to provide an EGR valve device which always assures that an adequate and proper control of EGR can be achieved.

According to the present invention, these objects are attained by comprising: a valve member urged to close the valve; a gear operatively coupled to the valve member and rotatable for causing the valve member to make opening and closing movements; and a driving motor having the shaft of its rotary member arranged to intersect a plane containing the gear at right angles and having, secured to the rotary member, a pinion meshing with the gear. The surfaces of those movable members such as the rotary shaft of the gear and the valve rod are applied with or impregnated with a solid lubricating agent to smoothen their sliding operations.

According to the device of the present invention, the rotation of the gear is converted to a stroke of the valve rod, whereby the degree of opening of the valve is controlled, so that when the driving motor stops in the midst of its operation due to, for example, its disorder, the valve member is brought immediately to its valve-closing position. position.

These and other objects as well as the features and the advantages of the present invention will be apparent from the following detailed description of the preferred embodiment when taken in conjunction with the accompanying drawings.

DETAILED DESCRIPTION OF THE PREFERRED EMBODIMENT

Figure 1:
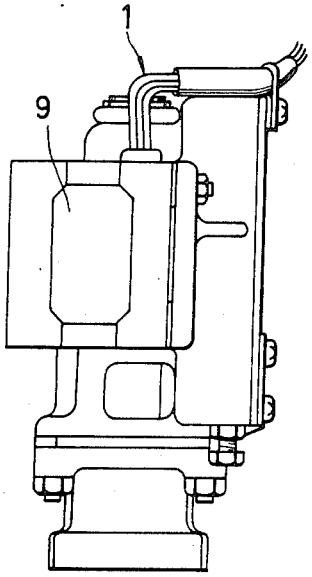
FIG. 1 is a side elevation of the EGR valve device according to the present invention.
Figure 3:
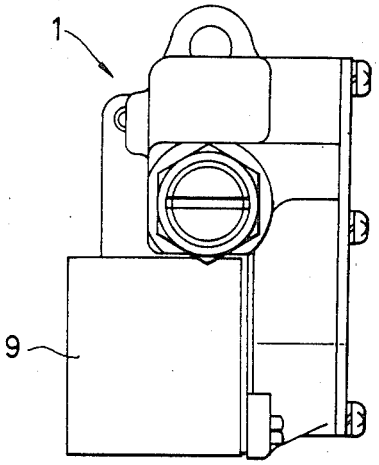
FIG. 3 is a top elevation of FIG. 1.
Figure 2:
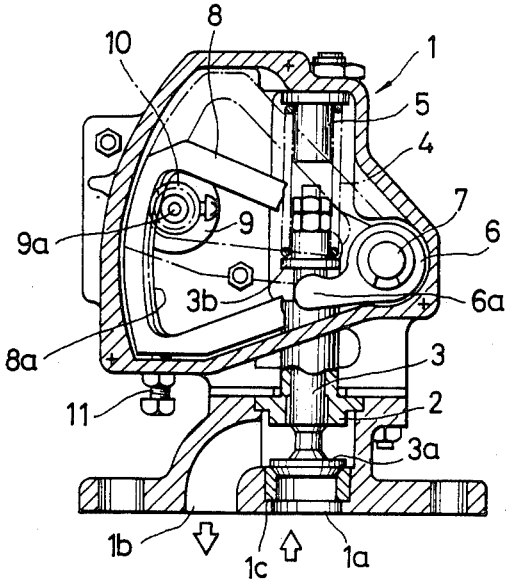
FIG. 2 is a right side elevation of FIG. 1 with a part broken away.

The present invention will hereunder be described in further detail based on an illustrated embodiment. In the drawings, reference numeral 1 represents an EGR valve body having an inlet port 1*a*, an exhaust gas outlet port 1*b* and a valve seat 1*c*; 2 a valve rod bearing secured to the valve body 1; 3 a valve rod slidably supported by the valve rod bearing 2 and having a valve member 3*a* at its bottom end and a flange 3*b* at its upper end portion; 4 a coil spring applied between a spring receptacle 5 and the flange 3*b* for urging the valve rod 3 downwardly, i.e. in the direction of closing the valve; 6 a lever rotatably supported by a shaft 7 secured to the valve member 1 so as to cross the valve rod 3 at right angles and disposed so that its forward end 6*a* is able to be brought into contact with the lower face of the flange 3*a*; 8 a sector-shaped gear supported on the shaft 7 for rotation integrally with the lever 6 and having an arcuate toothed portion 8*a*; 9 a driving motor such as a stepping motor which is attached to the valve member 1 in such a manner that the main shaft 9*a* of this motor intersects a plane containing the sector-shaped gear 8 at right angles; and 10 a pinion secured to the main shaft 9*a* of the motor 9 and meshed with the toothed portion 8*a* of the sector-shaped gear 8. It should be noted here that the device is arranged to be operative so that, when the sector-shaped gear 8 is in the position shown in the solid line, the valve rod 3 is kept certainly in the valve-closing position due to the load applied by being so urged by the spring 4, rendering the forward end 6*a* of the lever 6 to be positioned to depart, with a fine interval, from the bottom face of the flange 3*b*, causing the lower end face of the sector-shaped gear 8 to be brought into contact with the top of a stopper 11 which is adjustable by a screw, while when the sector-shaped gear 8 is rotated to the position shown by the chain line, the valve rod 3 is lifted up, via the lever 6, to the fully-open position of the valve.

Since the device of the present invention is constructed as described above, it should be noted that, when an actuating signal which is produced through computation by a control unit not shown based on the amount of the fuel supply and that of the air supply to the engine and also on the informations supplied from various sensors in inputted to the motor 9, this motor 9 is rotated in accordance with the applied actuating signal, causing the sector-shaped gear 8 to make a clockwise rotation for a certain angle from its position shown by the solid line. By this clockwise rotation of the sector-shaped gear 8, the valve rod 3 is lifted up via the lever 6, so that the valve member 3*a* departs away from the valve seat 1*c*. Thus, there is performed a recirculation of the exhaust gas in an amount suitable for the state of the engine at such a moment. In such a case, if the power supply to the motor is cut off due to the occurrence of some electric mishap, the valve rod 3 is caused immediately (within 0.1 second) to descend to the valve-closing position by the force of the spring 4. Along therewith, the lever 6 and the sector-shaped gear 8 also are brought back to their positions indicated by the solid lines. As a result, there never happens that the functions of the engine are impaired extremely in any case.

It should be noted here that the respective surfaces of the toothed portion 8*a* of the sector-shaped gear 8, the pinion 10, the shaft 7 and the valve rod 3 are applied, by means of coating and/or baking, with a lubricating agent such as a solid lubricating agent, having anti-abrasiveness and heat-resistance, prepared by mixing, for example, graphite, molybdenum disulfide and the like, and moreover the members such as the sector-shaped gear 8, the pinion 10 and the valve rod bearing 2 are made with an oil-containing sintered alloy. Accordingly, the valve device can be always operated smoothly with no supply of an lubricating oil.

As stated above, according to the present invention, not only the valve device as a whole can be constructed in a compact size, but also by appropriately selecting the gear ratio between the sector-shaped gear 8 and the pinion 10 and also the lever ratio between the sector-shaped gear 8 and the lever 6, it becomes possible to use a small torque, i.e. a small-size motor. Thus, the device of this type can be manufactured in a compact size and at a low cost. Also, because the valve rod is always urged toward the valve-closing direction, the valve is always held in its closed state unless the motor is driven. Therefore, there is provided an EGR valve device having a high degree of safety.

What is claimed is:

1. An EGR valve device for internal combustion engines of automobiles, comprising:

a valve body;

a valve rod slidably borne on said valve body and having, at one end, a valve member capable of opening and closing an exhaust gas recirculation path and being urged to close the valve;

a sector-shaped member rotatably supported on said valve body and operatively coupled to said valve rod and having a gear portion; and a driving motor secured to said valve body in such a way that its rotary member shaft intersects a plane containing said sector-shaped member at right angles, and having a pinion secured to said rotary member shaft and meshed with said gear portion of said sector-shaped member.

2. An EGR valve device according to claim 1, in which:

a solid lubricating agent is applied to the surface of the gear portion of said sector-shaped member, the surface of the rotary shaft for said sector-shaped member and the surface of said valve rod.

3. An EGR valve device according to claim 1, in which:

the operative coupling between said valve rod and said sector-shaped member is performed by a flange provided on said valve rod and by a lever provided concentrically and integrally with said sector-shaped member and being engageable with said flange, said valve device further comprising:

a stopper adjustably screwed to said valve body and engaging said sector-shaped member to adjust the relative position between said flange and said lever when said valve rod is at the valve-closing position.

* * * * *